United States Patent [19]

Clark

[11] 4,334,765

[45] Jun. 15, 1982

[54] BOOKLET PREPARATION UTILIZING AN ELECTROPHOTOGRAPHIC APPARATUS

[75] Inventor: Gary A. Clark, Longmont, Colo.

[73] Assignee: International Business Machines Corporation, Armonk, N.Y.

[21] Appl. No.: 158,036

[22] Filed: Jun. 9, 1980

[51] Int. Cl.[3] ..... G03G 15/00

[52] U.S. Cl. ..... 355/14 SH; 355/3 SH; 355/8; 355/24; 355/25; 271/185; 271/186

[58] Field of Search ..... 355/8, 3 R, 14 R, 14 C, 355/3 SH, 14 SH, 7, 24, 25; 271/185, 186, 4

[56] References Cited

U.S. PATENT DOCUMENTS

| | | | |
|---|---|---|---|
| 2,682,193 | 6/1954 | Schubert et al. | 88/24 |
| 3,289,530 | 12/1966 | Samain | 88/24 |
| 3,947,270 | 3/1976 | North | 96/1.4 |
| 4,050,805 | 9/1977 | Hage | 355/14 |
| 4,074,934 | 2/1978 | Satomi | 355/14 |
| 4,125,324 | 11/1978 | Spence-Bate | 355/23 |
| 4,129,377 | 12/1978 | Miyamoto et al. | 355/14 SH |
| 4,134,672 | 1/1979 | Burlew et al. | 355/14 |
| 4,140,387 | 2/1979 | Gustafson | 355/14 |
| 4,158,500 | 6/1979 | DiFrancesco | 355/14 |
| 4,188,881 | 2/1980 | Bruning | 101/141 |
| 4,194,832 | 3/1980 | Tabayashi | 355/11 |
| 4,209,249 | 6/1980 | Clark et al. | 355/14 R |
| 4,218,130 | 8/1980 | Satomi et al. | 355/14 R |
| 4,272,180 | 6/1981 | Satomi et al. | 355/3 SH |
| 4,277,163 | 7/1981 | Ikesue et al. | 355/14 R |

OTHER PUBLICATIONS

Research Disclosure, "Sheet Receiving and Stacking Apparatus", J. E. Smith, Oct. 1979, No. 18648.

*Primary Examiner*—Arthur C. Prescott
*Attorney, Agent, or Firm*—Gunter A. Hauptman

[57] ABSTRACT

In an electrophotographic apparatus, a plurality of original sheets are copied onto a plurality of copy sheets in an order permitting assembly of multiple-sheet booklets. The originals are presented to an automatic document feeder by an operator in one order which repeatedly presents the originals to the copier for reproduction in another order. The copies are reduced in size and placed adjacent each other onto both sides of sheets of copy paper in a sequence facilitating booklet assembly. Initially the originals are loaded into the automatic document feeder with the lowest numbered original page presented to the copier first. Odd-numbered originals are copied onto successive halves of copy sheets. When half of the originals have been copied, the copies are reloaded into the copier to permit copying of odd-numbered originals onto halves of the backs of the same copies. Thereafter, the originals are restacked in reverse order with the last-numbered page presented to the copier first, and the copies are reloaded. Copying is completed by copying the even-numbered originals onto the remaining halves of the copies, in the same manner as the odd-numbered originals, to give a completed booklet. Copy operation may be facilitated: by the use of a recirculating document feed in place of the automatic document feed, by rotation of originals or copies during the reloading/restacking operation or by double exposure of the copies. Duplexed originals may be used in place of originals having images on one side only.

17 Claims, 11 Drawing Figures

BOOKLET PREPARATION UTILIZING AN ELECTROPHOTOGRAPHIC APPARATUS

CROSS-REFERENCES TO RELATED APPLICATIONS

Reference is made to the following applications and patents for the material disclosed therein which is incorporated herein by this reference:

(1) U.S. Pat. No. 4,136,862, entitled "Paper Orientation for Duplexing and Collating", by B. H. Kunz et al., Ser. No. 787,140, filed Apr. 13, 1977, issued Jan. 30, 1979, assigned to International Business Machines Corporation.

(2) Ser. No. 903,346, now U.S. Pat. No. 4,206,996, entitled "Job Recovery Method and Apparatus", by G. A. Clark et al, filed May 5, 1978, assigned to International Business Machines Corporation.

(3) Ser. No. 926,979, now U.S. Pat. No. 4,203,585, entitled "Document Feed for a Copier Machine", by B. H. Kunz et l., filed July 21, 1978, assigned to International Business Machines Corporation.

(4) Ser. No. 100,775, entitled "Electrical Drive for Scanning Optics in a Continuously Variable Reduction Copier", by N. Cail et al., filed Dec. 6, 1979, assigned to International Business Machines Corporation.

BACKGROUND OF THE INVENTION

1. Field of the Invention

This invention relates to electrophotographic apparatus and, more particularly, it relates to the formation of booklets from individual original sheets.

2. Description of the Prior Art

It is, of course, well known that to form a booklet from a series of original document sheets, it is desirable to place the original sheets in a particular order so that the booklet, when assembled, will maintain a logical reading order. For example, given a series of original sheets which are to be read in order from page one through page eight, it is logical to form a booklet which maintains the identical order. If the booklet is formed from sheets of paper carrying four images of the original on each sheet of paper, the booklet copy will contain images of the original which are not in sequential order. That is, the first original page appears on half of one side of the first copy and the second original page appears on half of the other side. The seventh and eighth originals will appear on the other halves of the first sheet of paper. The third and fourth originals will appear on the second sheet along with the fifth and sixth originals.

Commercially available reducing copiers with imaging areas large enough to copy two sheets of paper adjacent to each other and capable of duplexing (copying on both sides) copies from these originals, may be used to manually create booklets. For example, the IBM Series III copier instruction manual ("Series III Copier/Duplicator Model 10 and Model 20 Key Operator Instructions", Form No. S548-0300) describes a method for making booklets (signatures), from $8\frac{1}{2}'' \times 11''$ originals utilizing the reduction and automatic duplex features of the copier. The operation requires that originals be placed adjacent to each other on the document glass in an order calculated to give the booklet order previously described. Considerable operator involvement is required, because the order of originals is completely determined by the order in which the originals are placed on the document glass. Similarly, as described in operator's instructions 610P2625C (date unknown), the Xerox 7000 Signature Maker requires that different originals be selected from a sequential set of originals for copying in each of two copying passes. In U.S. Pat. No. 4,188,881, filed July 28, 1977, originals are divided by the operator into two stacks which are used in rotation to prepare a master for double-size copy sheets.

The prior art also describes techniques for forming adjacent images from sequentially-fed originals. This technique has the advantage of simplifying the manual operation which would otherwise be required to place two originals next to each other on a document glass. For example, U.S. Pat. No. 4,074,934, filed Feb. 26, 1976, discloses a method of forming an image on one section of a copier's drum and then rotating the drum by a plurality of image spaces before forming an image on another section. However, the patent forms a plurality of images from the same original. U.S. Pat. No. 2,682,193, filed Mar. 10, 1951, discloses the formation of side-by-side images of both the front and back of an original. Neither of the referenced patents relates to the production of booklets by a copier.

SUMMARY OF THE INVENTION

The invention facilitates the preparation of booklets by permitting simplified operator manipulations of a copier which forms adjacent images from sequential original sheets. Original documents carrying indicia to be copied are placed in an input stack and provided to a reproduction position, one original document at a time. An automatic document feed presents successive ones of the original documents from the input stack to the reproduction position, and an imaging surface receives, on a portion of its total imaging area, an entire image of an original document. Optics, intermediate the reproduction position and the imaging surface, impress on selectable portions of the imaging surface the image of the indicia of the entire original document present at the reproduction position. Blank copy sheets are provided to reproduction means to carry reduced images of the indicia on original documents. The original documents are initially fed to the copier in a first sequence, but are not all imaged. The copies thus made are reloaded for subsequent reimaging. The originals are then restacked and are again presented to the reproduction position, some of the previously unimaged originals forming images on different portions of the same copy sheets. Depending upon the number of originals, originals are restacked and copies reloaded until every original document is imaged. The reduced images of the originals are formed on the copies to preserve the desired booklet (signature) order necessary for paging. The originals are fed by either an automatic document feed or a recirculating document feed, and it is possible to form the images on portions of the copy sheets by controlling the speed of photoconductor scanning as well as by multiple exposure of the photoconductor. Rotation of the original and/or the copy sheets, in some cases, facilitates formation of booklets.

In one embodiment of the invention, the original document is scanned by the copier optics at a speed greater than the photoconductor motion which is otherwise synchronized. Thus, the image of the original document is formed on only a portion of the photoconductor area normally occupied by the image. If the image is also optically reduced, the image of the original document may be made to occupy exactly half of the area normally occupied. By timing the occurrence of the beginning and end of the scan and the operation of appropriate erase mechanisms, it is possible to place an image of the original document on either half of one side of a copy sheet. If desired, the copy sheet may be used in successive runs of the original sheets to form a series of copy sheets, each incomplete, before a set of complete sheets is formed. Alternatively, it is possible to completely image both halves of a copy sheet from successively selected ones of the original documents by imaging the original documents onto adjacent portions of the photoconductor surface before copying onto each copy sheet.

The foregoing and other objects, features and advantages of the invention will be apparent from the following more particular description of preferred embodiments of the invention, as illustrated in the accompanying drawings.

DESCRIPTION OF THE PREFERRED EMBODIMENTS

Figure 1A:
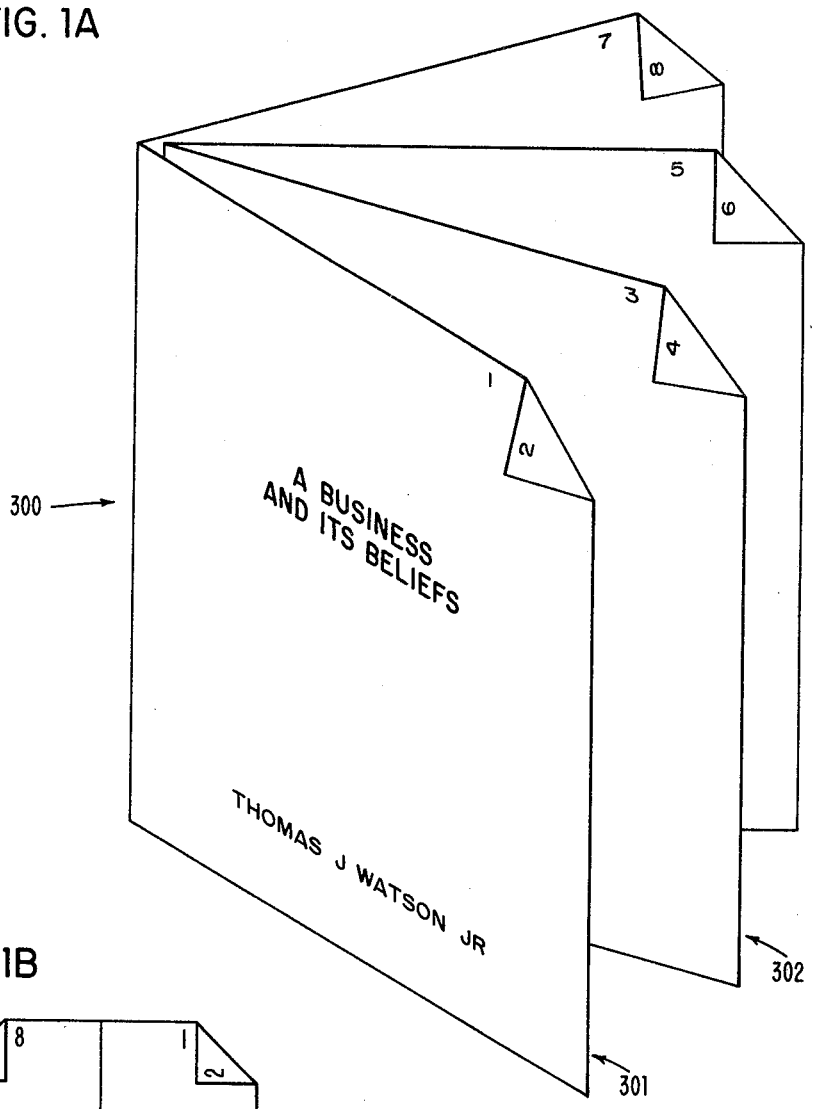
FIG. 1A is a view of a completed booklet.
Figure 1B:
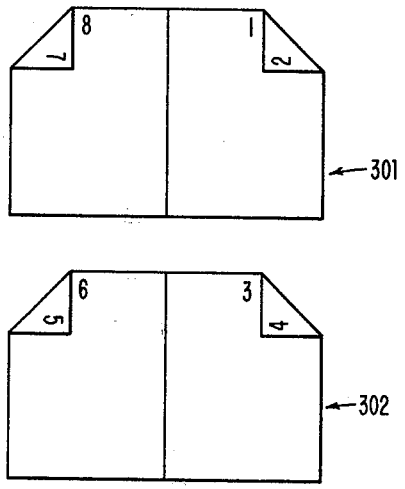
FIG. 1B is a layout of the sheets forming a booklet and FIG. 1C illustrates the sequence of operations required to form a booklet utilizing the invention.
Figure 1C:
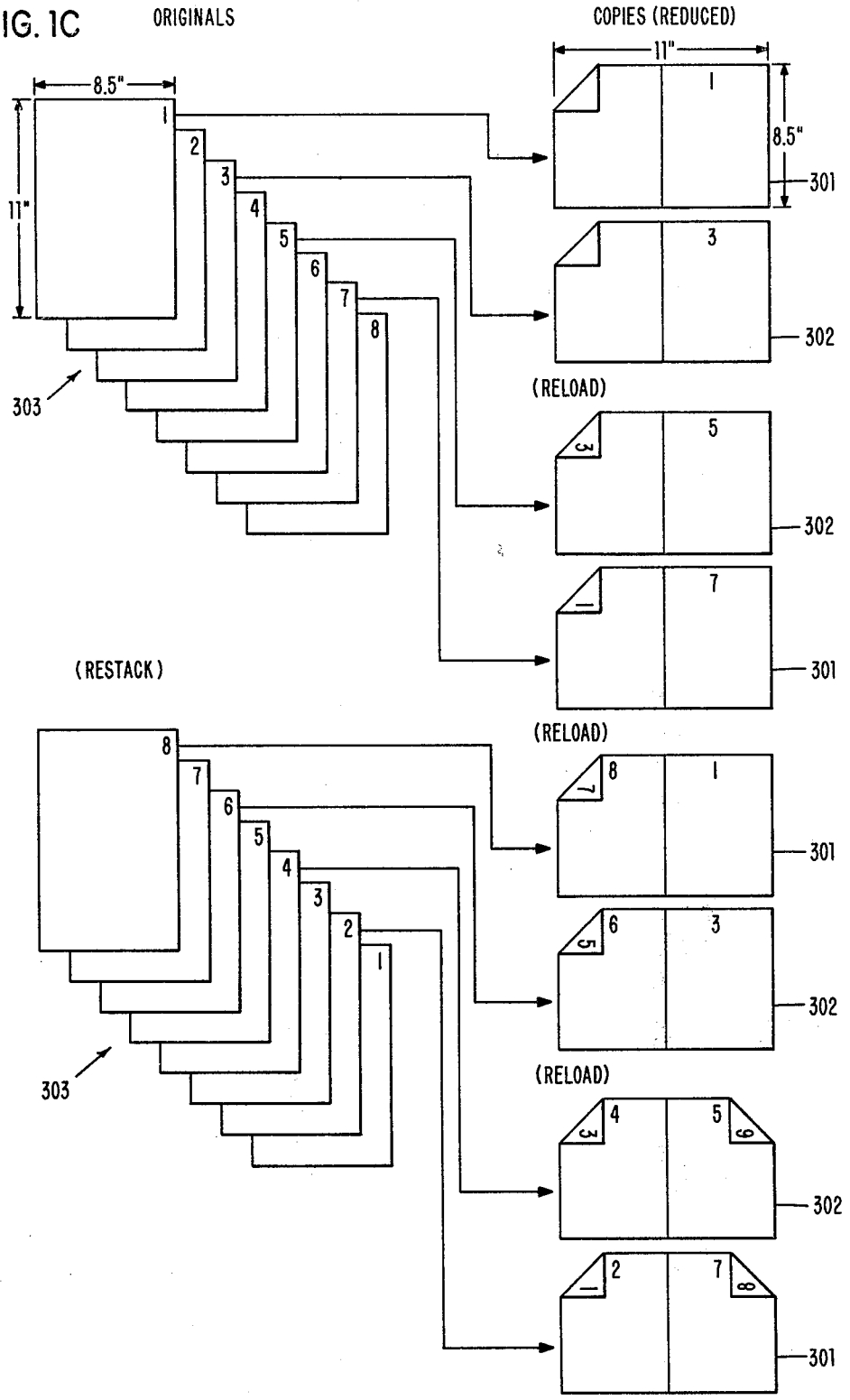

Referring to FIG. 1A, there is shown an 8-page booklet 300 formed of two sheets of paper 301 and 302 carrying pages -1- through -8- on both sides of both sheets. The sequential order of pages -1- through -8- is achieved, as shown in FIG. 1B, by a nonsequential placement of the images of the pages on halves of both sides of the sheets 301 and 302. For example, sheet 301 carries pages -1- and -8- on one side and pages -2- and -7- on the other side. The booklet 300 is formed from a sequential series of original sheets of paper carrying pages -1- through -8- on single sides of eight successive sheets of paper 303 as shown in FIG. 1C. If desired, the originals may instead consist of only four sheets of paper each carrying two pages, one on each side thereof. The original sheets of paper, shown with standard dimensions of $8\frac{1}{2}'' \times 11''$, are reproduced on copy sheets which are the same size. Thus, each original must be reduced by approximately 35% (for convenience, "50%" hereinafter) on the copy sheet. If desired, different size originals and copies may be used. For example, it may be desirable to produce images that are the same size as the originals on larger sheets of copy paper.

Referring to FIG. 1C, originals 303 are initially arranged in sequential order with the lowest number page, page -1-, at the top and the highest number page, page -8-, at the bottom of a stack of originals. While the formation of a booklet of eight pages is shown for illustration, it will be apparent that any number of pages may be copied in this manner. It is assumed that originals 303 are presented to the copier from the top of the stack, that is page -1- is presented first. If originals 303 are instead selected from the bottom of the stack, a reverse stack order would be desirable.

When page -1- is presented to the copier, a reduced image thereof is placed on the right-hand side of copy sheet 301. The orientation of an original sheet 303 and the image of that sheet on the copy sheet 301 are determined by the characteristics of the copier. It may be desirable, for example, to rotate the originals 303 as they are entered into the copier. After the formation of the image on half of the copy sheet 301, additional blank copy sheets may receive identical images, depending upon the number of booklets to be formed. Assuming that the desired number of copies has been made, the next original 303, page -2-, is skipped and an image of the succeeding original page, page -3-, is placed on another copy sheet 302, as shown in FIG. 1C. Again, the necessary number of copies, identical to sheet 302, is made. Thereafter, the next successive original 303, page -4-, is skipped. When half of the original pages have been processed, that is four of the eight original sheets 303 in this example, the copies 301 and 302 are removed from the copier exit area. Copies 301 and 302 are loaded into the copier's blank paper entry area in an order which presents them for imaging in a sequence opposite to the one just described. The next original 303, page -5-, is then imaged onto one-half of the copy sheet 302, which already contains page -3- on the other side thereof. This requires that the copies be reloaded upside down so that they will be presented in reverse order. When the desired number of copies of page -5- has been made, the next sequential original page, page -6-, is skipped and page -7- is copied onto half of copy sheet 301. Once the desired number of copies of page -7- has been made, the originals 303 are restacked and the copies 301–302 are reloaded.

Still referring to FIG. 1C, the originals are now placed in an order which presents them to the copier in a sequence which is the reverse of the previous sequence. The copies are removed from the copier and placed into its blank paper entry area upside down so that they are presented for copying in reverse order from that just described. Thus, the first original 303, page -8-, is placed onto one-half of the copy which already contains page -1- on one side and page -7- on the other side. Note that in this sequence of copying operations, the copier is adjusted to place the image adjacent the image previously placed on the same sheet of the copy paper. Thus, sheet 301 contains page -1- on the right-hand and page -8- on the left-hand of one side and page -7- on the right-hand of the other side. When the desired number of copies of page -8- has been made, original page -7- is skipped and page -6- is copied onto sheet 302 adjacent to page -3- and on the back of the side which carries page -5-. Thereafter, when a sufficient, pre-specified, number of copies is made of page -6-, the copy sheets 301-302 are reloaded upside down to present them for further copying. Page -5- is skipped and original page -4- is then copied adjacent page -5- on sheet 302 and (when a sufficient number of copies of page -4- have been made) page -3- is skipped and page -2- is copied adjacent page -7- on sheet 301. The operation ends at original page -1-, which already appears on sheet 301.

Figure 2:
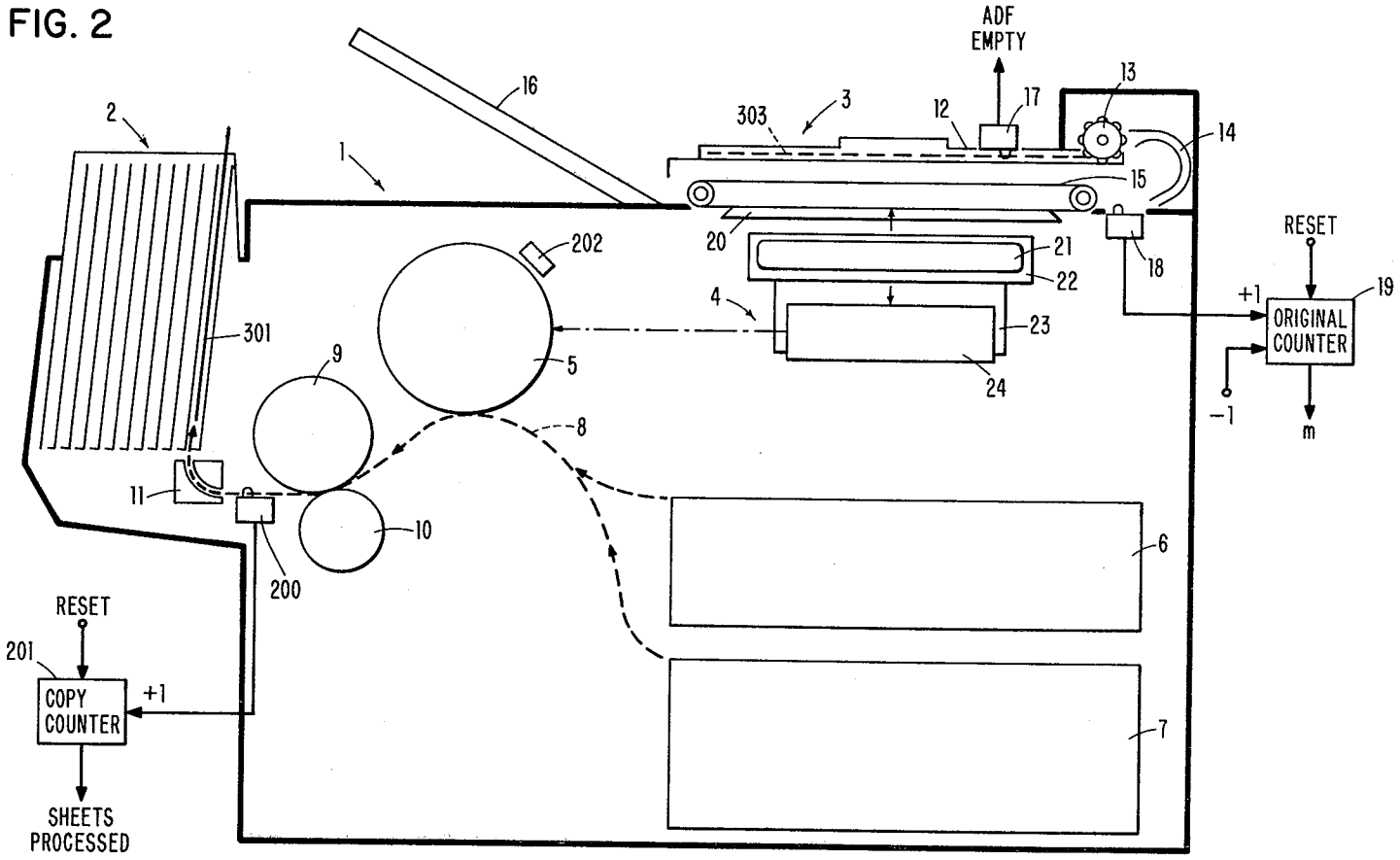
FIG. 2 is a general view of an electrophotographic copier capable of operating in accordance with the invention.

Referring to FIG. 2, there is shown apparatus for performing the booklet-copying operation just described. Copier 1 comprises a collator 2 for receiving sheets of paper 301, initially loaded as blank sheets of copy paper in an entry area comprising bins 6 and 7, carrying images of originals 303 placed in an automatic document feed 3. Original sheets of paper 303 are placed face-up at an input station 12 from which they are removed topmost first by a rotating wheel 13 which sends them through path 14 onto a belt 15 and then to a document glass 20 for imaging in a manner described in the previously referenced Kunz et al patent application Ser. No. 926,979. The belt 15 drives imaged originals from the document glass 20 to an output tray 16. Thus, a stack of original documents 303 is placed at the input position 12, imaged at the document glass 20 and then restacked face-down at the output position 16. The relative sequence of original sheets is maintained because the wheel 13 removes the first of sheets 303 from the top of the stack and the belt 15 places successive sheets 303 at the bottom of the stack at the output 16. There is provided a switch 17 which indicates when no further originals remain at the input position 12. There is also provided a switch 18 which steps a counter 19 +1 whenever a sheet is fed to the document glass 20. The counter 19 may also be decremented −1 and may be reset to 0, or any other desired quantity. A count m stored in the counter 19 indicates the number of originals 303 fed to the document glass 20. This number is contrasted with another number n, indicating the number of originals actually placed in the input position 12 by the operator, as will be subsequently explained.

When an original 303 is placed on the document glass 20, optics 4 presents an image of the information on the original to a photoconductive carrier 5 as described in detail in the previously referenced Clark et al. patent application Ser. No. 903,346. The image is obtained by scanning light across the original 303 under control of optical elements 21–24 to place an electrostatic image thereof on the carrier 5, which image is then transferred to blank sheets of paper from bins 6 and/or 7 as they pass the carrier 5 on path 8 through fuser 9 and backup roller 10. Imaged copy sheets, for example 301, are accumulated in the collator 2 as described in the referenced U.S. Pat. No. 4,136,862 of Kunz et al. A switch 200 is provided in the path 8 to indicate when a copy sheet passes through a diverting channel 11 into the collator 2. Each sheet causes a copy counter 201 to be incremented +1. The copy counter 201 may be reset to any desired quantity and indicates by its output the number of sheets passed to the collator since the copy counter 201 was last reset. The photoconductive carrier 5 and the optical system 4 are interrelated in a manner which causes the original document 303 on the document glass 20 to be scanned by the optics 4 at a rate which is related to the velocity of the carrier 5. As described in the previously referenced Cail et al. Ser. No. 100,775, it is possible to vary the point at which the image of the original 303 on the glass 20 is placed on the carrier 5. It is desirable, for purposes of the invention herein, to both vary the point at which the image is placed on the original 303 and the size of that image. Reduction optics are provided in the optical system 4 for the purpose of varying the image size. The image of the original 303 on the document glass 20, may, for example, be reduced one-half and placed on successive halves of an image area on the carrier 5. There is provided an erase mechanism 202, for erasing any residual image from the other half of the image area not utilized for imaging the original 303 on the document glass 20.

Figure 3A:
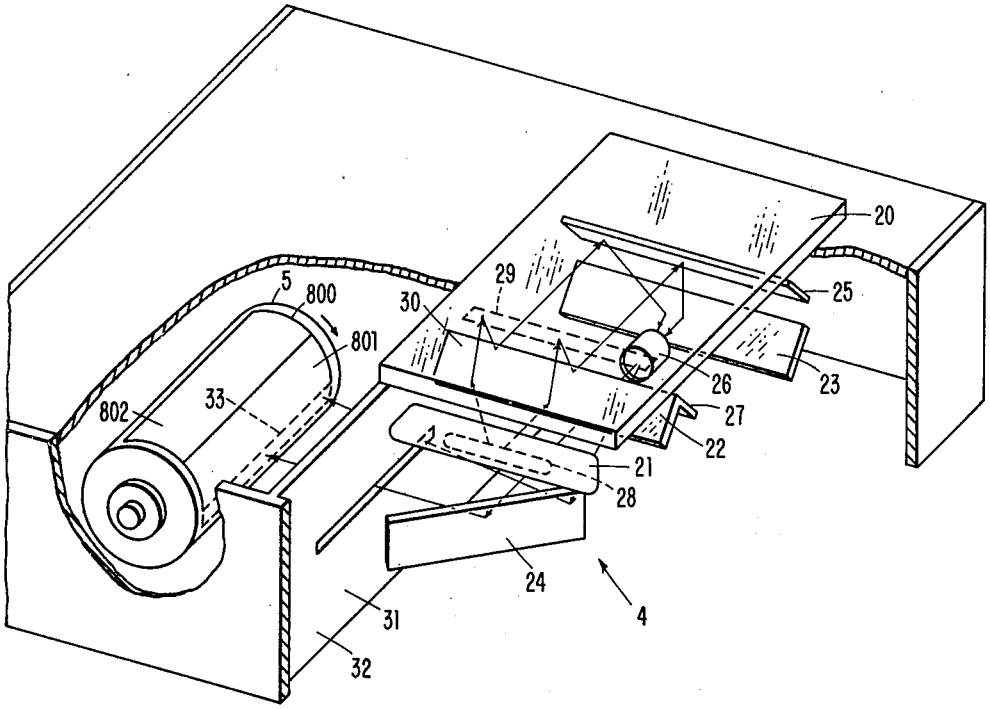
FIG. 3A is a three-dimensional view of optics used in the copier of FIG. 2
Figure 3B:
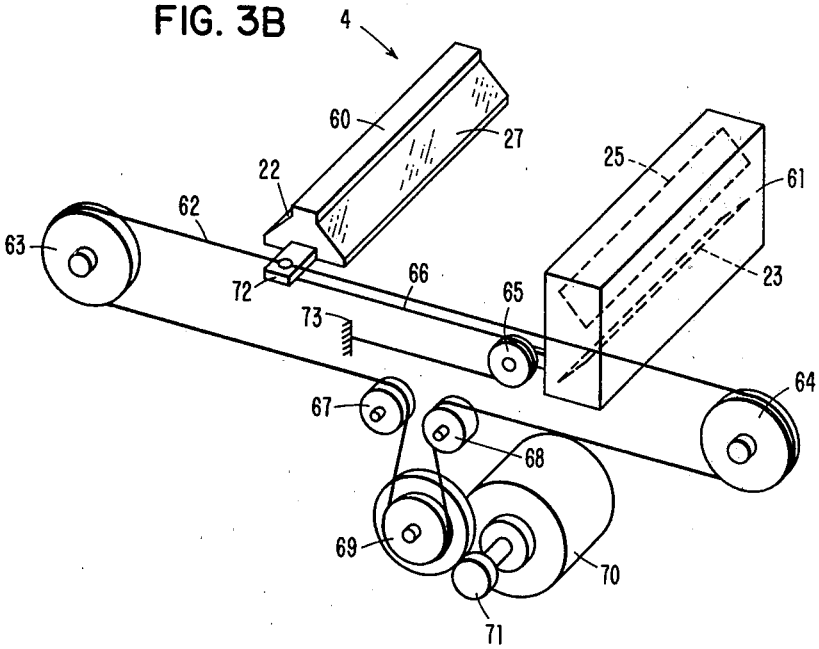
FIG. 3B shows additional detail of the optics of FIG. 3A.

Details of the optical system 4 appear in FIG. 3A. The image of the original document 303 placed on the document glass 20 appears, starting at area 33, on the photoconductive carrier 5 as light from a lamp 28 is scanned across the plane of the document glass 20. The scanning is achieved by moving mirrors 22, 23, 25 and 27 relative to stationary original document 303. As a result, a "footprint" of light 29 scans across the document glass 20 in a position and at a velocity determined by the relative motion of the mirrors 23 and 25 and 22 and 27. The direction of scan may be either from the front to the back of the copier or vice versa. In the embodiment shown, a back-to-front scan has been chosen. Additional mirrors 21 and 24 are provided to channel the light path from the lamp 28 to the photoconductor 5. FIG. 3B illustrates apparatus for driving the mirrors 22, 23, 25 and 27. Carriers 60 and 61 are connected to cable 62 which is threaded over pulleys 63, 64, 65, 67, 68 and 69. Motor 70, via gear 71, drives the carriers 60 and 61 at a relative velocity determined by where the ends of the cable 62 are connected to moving point 72 and fixed point 73. Thus, referring again to FIG. 3A, the length of the path of light from the lamp 28 to the photoconductive surface 5 is changed as the motor 70 drives the carriers 60 and 61 relative to each other. The speed at which they are driven relative to each other determines the speed at which the footprint 29 scans the document glass 20. Inasmuch as the photoconductive carrier 5 rotates at a fixed velocity, it can be seen that changing the speed of the motor 70 will change the position at which the image area 33 starts on the photoconductive carrier relative to a given position on the photoconductive carrier. That is, the faster the document glass 20 is scanned, the earlier the image will appear on the photoconductive carrier 5.

Figure 4:
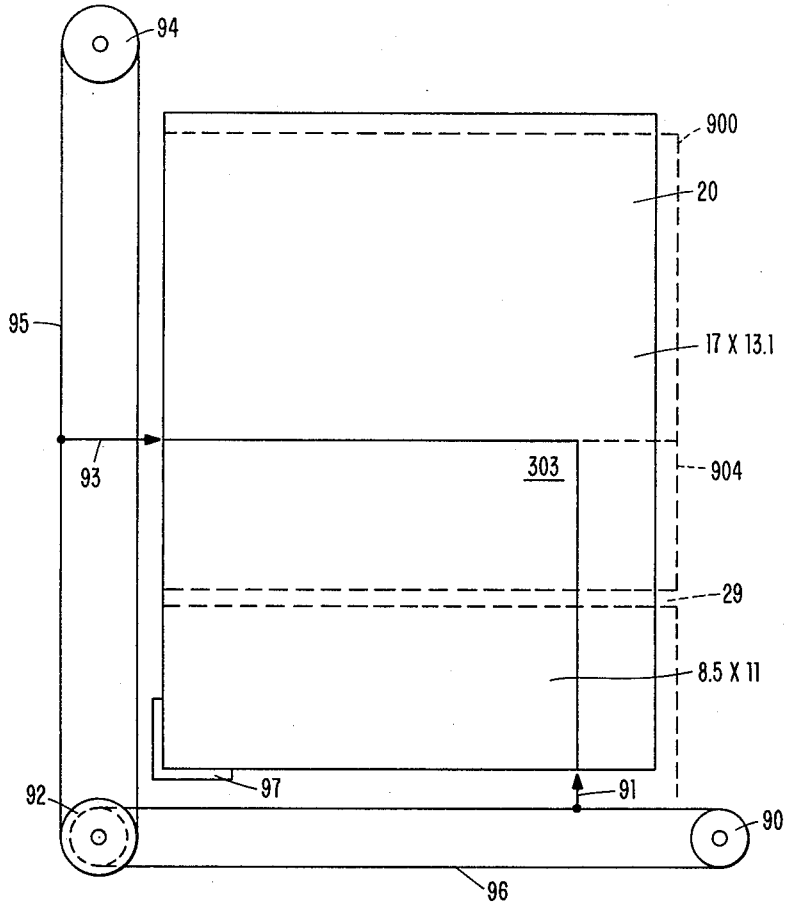
FIG. 4 is a plan view of the document glass of the copier of FIG. 2.
Figure 5:
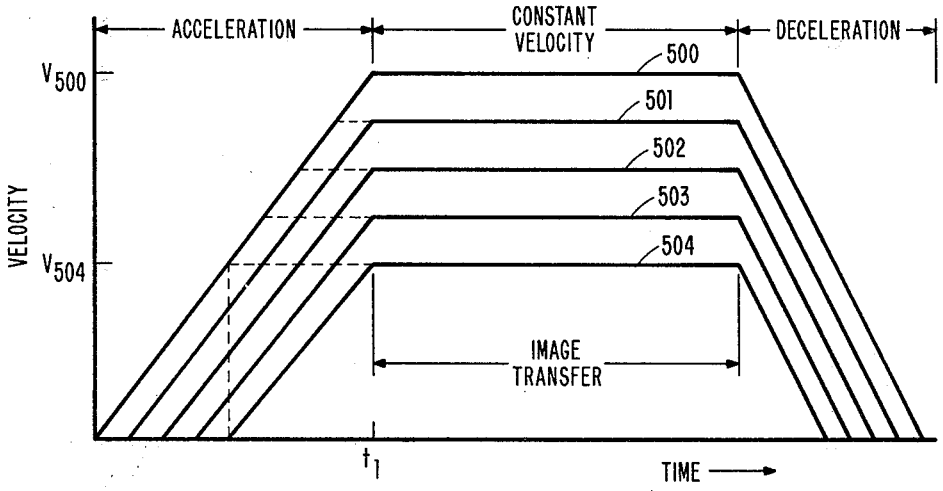
FIG. 5 is a graph illustrating the relationship between the document scanning and photoconductor rotation.

FIGS. 4 and 5 will aid in understanding the relationship of the scanning of the document glass 20 and the motion of the photoconductive carrier 5. Referring first to FIG. 4, the document glass 20 is shown carrying an original document 303 aligned against a corner stop 97. Pointers 91 and 93 carried on cables 95 and 96 and threaded through pulleys 92 and 94 identify the amount of reduction required as explained in the previously referenced Cail et al. Ser. No. 100,775. Referring also to FIGS. 3 and 5, the speed at which the footprint of light 29 passes over the document glass 20 determines the space occupied by the resulting image area 33 on the photoconductive carrier drum 5. The faster the document glass 20 is scanned, the more the image area on the glass 20 is scanned during a given time corresponding to the time it takes a given area of the drum 5 to pass in front of the optics 4. Thus, given a fixed image transfer time (starting at $t_1$), a first portion 904 of the area of document glass 20, for example the area occupied by the original document 303, will be exposed if the scan occurs at a velocity $V_{504}$. If instead the scan occurs faster, for example at velocity $V_{500}$, the same area on the drum 5 will be exposed, but instead, a much larger area 900 of the document glass 20 will have been imaged, for example almost the entire area. Thus, by adjusting the speed of scan to intermediate velocities $V_{501}$–$V_{503}$, it is possible to change the area of the document glass 20 which is made available to a fixed area on the drum 5. Further, by starting the scan at a time different than $t_1$, it follows that the image of original 303 can be placed at different positions on the drum 5. For purposes of the invention, it is desirable that the image of the original 303 be placed in selected halves 801 and 802 of an image area 800 on the photoconductive surface 5 as shown in FIG. 3A. If the lens 26 is arranged to form an image either 801 or 802 on the photoconductive surface of the drum 5 which is one-half the size of the document 303 on the document glass 20, then it is possible to form, on the surface 5 in an area 800 identical to the size of the original document 303 on the glass 20, an image on either half 801 or 802 of the area 800 on the carrier drum 5. Alternatively, the same effect can be achieved with one drum position by rotating both the original and copy 180°.

Assuming that a selected image area on the carrier drum 5 carries a half-size version of the original document on the document glass 20, it is then possible to place this image on the blank copy sheet in path 8 of FIG. 2 in one of two ways. Either the sheet from the bins 6 and/or 7 is made to receive images on halves 801 and 802 of the carrier drum image 5 in two successive passes, or the carrier drum 5 is imaged twice and then both image halves 801 and 802 are transferred to a copy sheet simultaneously in one pass.

Figure 6:
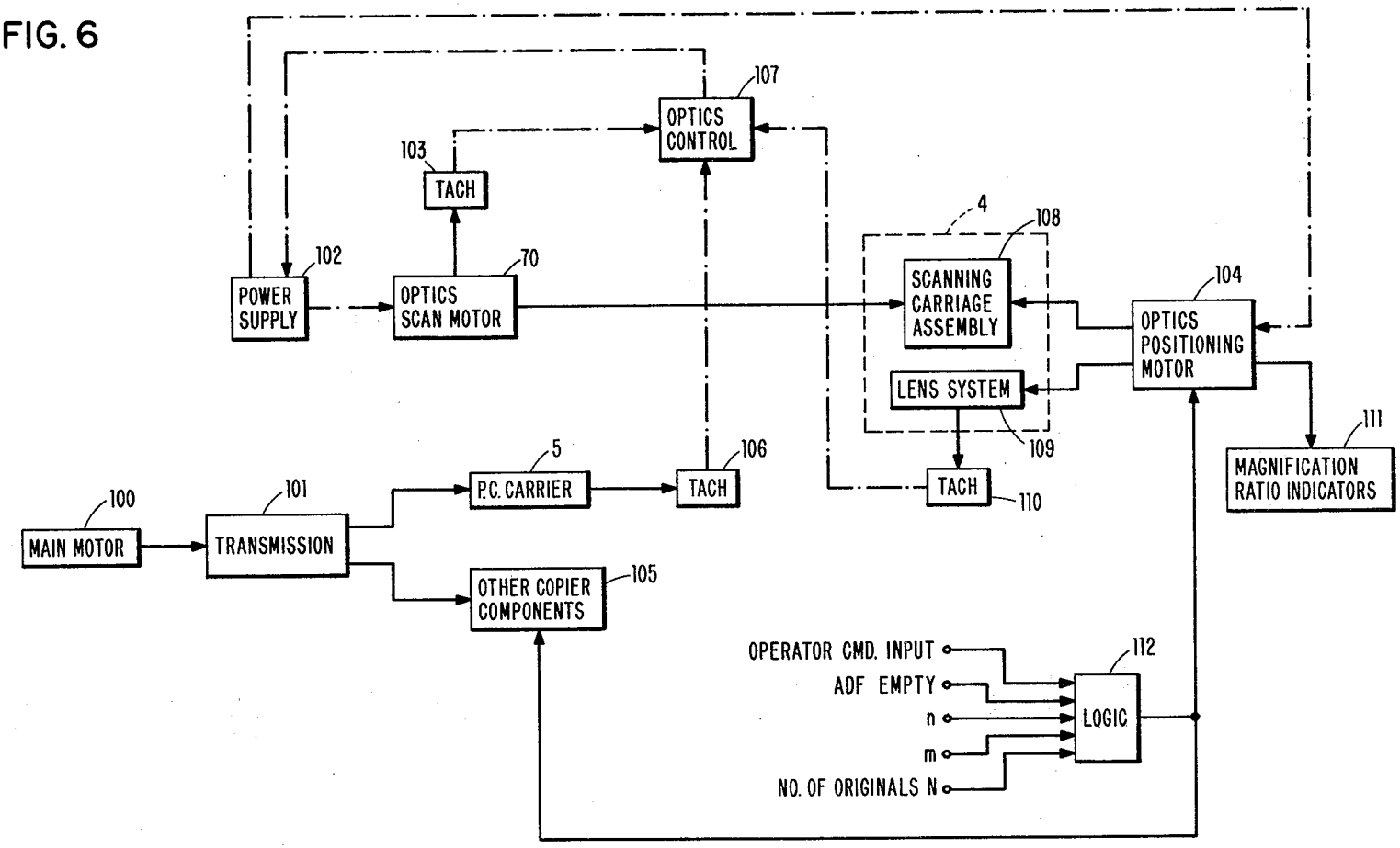
FIG. 6 is a block diagram of the electronics logic which is associated with the copier of FIG. 2.

The interrelation of the carrier drum 5 motion and the optics 4 motion is controlled by the circuit shown in block diagram form in FIG. 6. A main motor 100 drives the photoconductive carrier drum 5 and other mechanical components 105 through a transmission 101. A tachometer 106, mounted on the carrier 5, provides a velocity signal to optics control 107, which signal is compared with signals from another tachometer 103 driven by optics scan motor 70. Thus, the relationship between the speed of the photoconductive carrier drum 5 and the optics scan motor 70 is maintained by the optics control 107 which adjusts the speed of the optics scan motor 70 through a variable power supply 102. The same power supply 102 adjusts the position of the copier optics via an optics positioning motor 104 which relatively positions the lens assembly 4, scanning carriage assembly 108 and lens system 109. The optics control 107 monitors the speed at which optics positioning motor 104 moves the lens system 109 through a tachometer 110. Magnification ratios, that is the reduction ratio, are recorded by indicators 111. Logic 112 receives operator command inputs such as the number of copies to be made, the number of originals (n), whether or not the automatic document feed is empty, the number of originals processed (m), the number of copies made, etc. This data controls the copier utilizing apparatus described in the referenced Cail et al. Ser. No. 100,775 and may, alternatively, utilize any appropriate microprocessor.

Figure 7A:
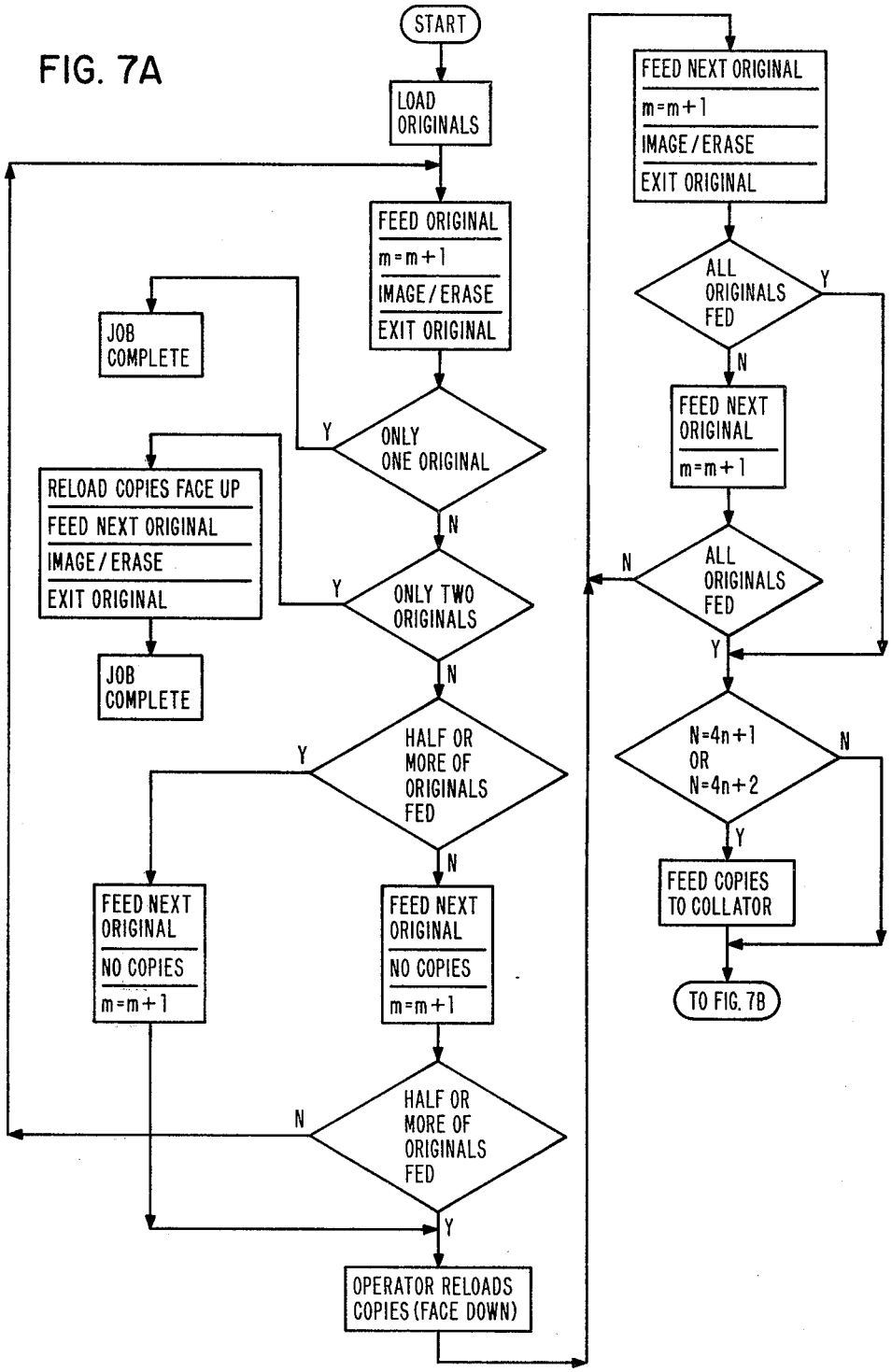
FIGS. 7A and 7B are flow diagrams illustrating operation of the invention.
Figure 7B:
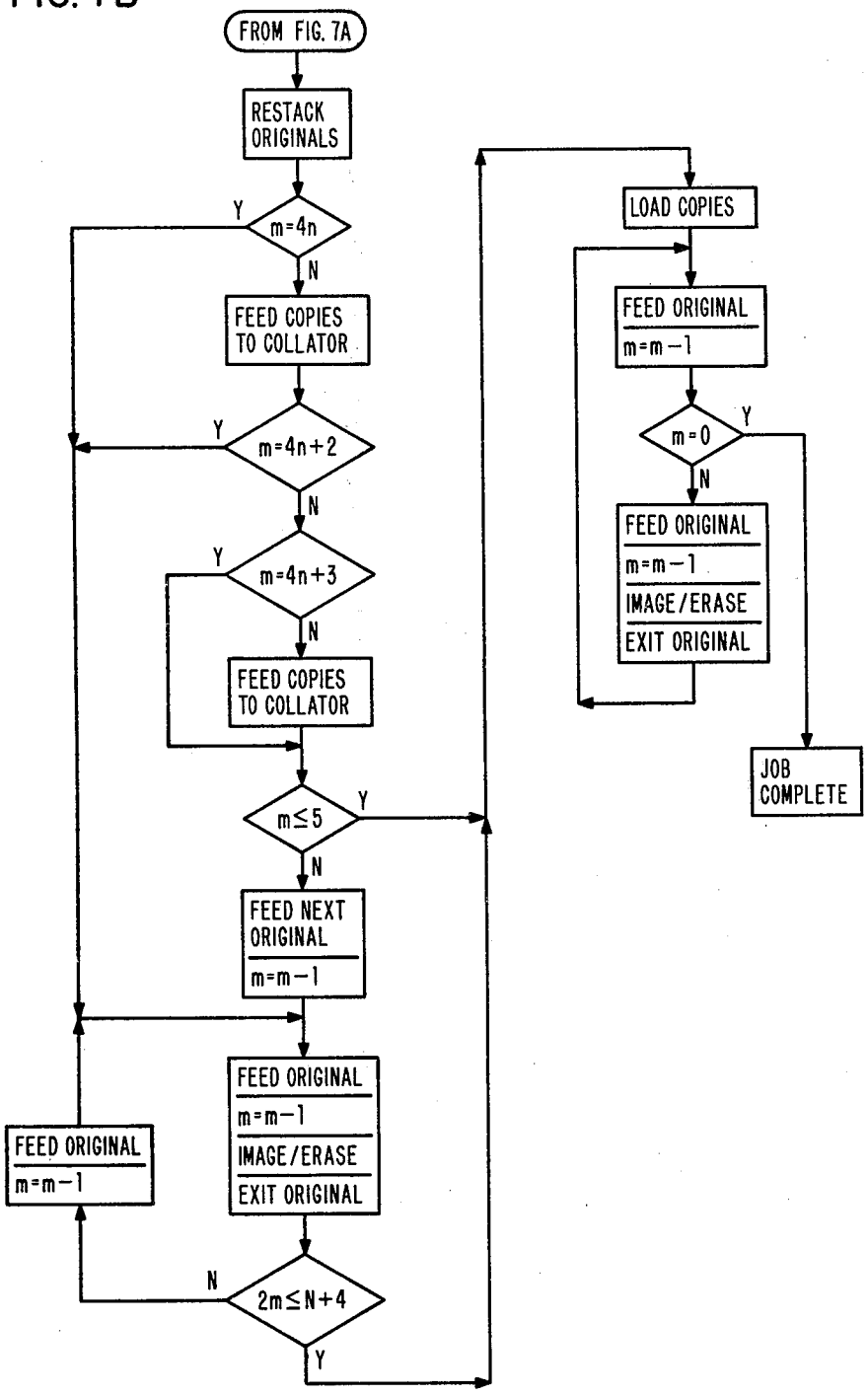

Referring now to FIGS. 7A and 7B, the operation of the preferred embodiment, wherein the images 801 and 802 are formed individually on the photoconductive carrier drum 5 and transferred to a copy one at a time, will be described. In FIG. 2, the operator initially loads originals 303 into the automatic document feed 3 input tray 12 with the tops of the originals 303 (indicated by the page numbers in FIG. 1C) towards the right and with the lowest numbered page on the top. The operator enters the number of originals (n), selects the desired reduction (50%), the number of copies desired, etc. The rotating wheel 13 in automatic document feed 3 then feeds the original 303 page -1- through path 14 and onto the document glass 20 and the counter 19 is incremented +1. The requested number of copies 301, etc. is made and placed in the collator 2. The full page -1- on the document glass 20 is imaged (reduced 50%) onto the left half of each copy sheet 301 to form half blank copies 301 by utilizing area 801 on drum 5. Since page -1- occupies half of glass 20, the area 802 on drum 5 is erased by erase lamp 202 to maintain a clean half of sheet 301. The automatic document feeder 3 belt 15 causes page -1- to leave the document glass for the output area 16 when the desired number of copies has been made. If the operator has indicated that there is only one original, that is, page -1- is the only one to be copied, the job is complete. If the operator has indicated that there are only two originals, that is, pages -1- and pages -2-, then the copier is stopped and the operator must reload the copy sheet 301 into the paper supply 6, 7 face-up with the page -1- copy to the right. The copier is then restarted. Page -2- is copied (reduced 50%) on sheet 301 adjacent page -1- and the job is completed. Assuming that there are more than two originals 303 to be copied, and that less than half of the originals have been fed through the automatic document feed 3, the next original page -2- passes through to the output area 16 without making any copies. As this sheet, page -2-, passes switch 18, the counter 19 is incremented. These operations are repeated as long as half of the originals 303 have not passed through the automatic document feed 3, that is: odd-numbered originals pages -1-, -3- (and additional odd-numbered pages amounting to less than half of the number of originals), will be copied onto right-hand sides of blank sheets of copy paper 301, 302, etc. Even-numbered originals, page -2-, page -4-, etc. will not be copied but will be passed to the output area 16. Whether or not the original page is copied, the counter 19 is incremented to keep track of the number of pages m. Whenever copies are made of an original page 303, a sufficient number of copies n is placed in the collator 2.

Once the number of original pages 303 processed is equal to or greater than the half of the number of originals indicated initially by the operator, the copier stops and the operator reloads the copies 301, 302, etc. into the paper supply 6 or 7 with page -1- copies face down and toward the left. The automatic document feed 3 then feeds the next successive original (for example page -5- if there are eight originals) onto the document glass 20. The copier processes the number of copies desired and places them in the collator 2. The page, page -5-, on the document glass 20 is imaged (reduced 50%) onto right half of each copy 302, 301 (in reverse order). The automatic document feed 3 then causes the original page -5- to leave the document glass for the output area 16. Assuming that not all of the originals 303 have passed through the automatic document feed 3, the automatic document feed 3 feeds the next original, page -6-, to the output area 16 without making any copies. However, the counter 19 is incremented by one. The preceding operations are repeated to place successive odd-numbered pages on right-hand sides of the backs of copies 301 and 302 until all of the originals 303 have been processed by the automatic document feed 3. Once all of the originals have been processed, it is necessary to determine whether there will be a complete utilization of all pages in the finished booklet—that is, whether there will be a copy with a blank page at the end. If the total number of originals n equals $4d+1$ or $4d+2$ (where d is any positive integer), the copier feeds all of the copies 301 of page -1- through to the collator 2 without copying. Otherwise, this operation is not necessary.

The copier now stops and the operator restacks the originals 303 into the automatic document feed 3 in an order which is the reverse of the order in which they had originally been stacked therein (page -8- on top). The copies are removed from the collator 2 and replaced into the entry area 6 or 7 with copies of page -1- up and to the right. At this point, the counter 19 contains a count m which equals the total number of originals provided. Assuming that this count m equals 4d (any integral multiple of 4, which occurs when 4, 8, 12 or 16, etc. total originals are copied), then the previous procedure continues with the counter 19 being stepped down $-1$ for each original which passes through the automatic document feed 3 as previously described.

If the number of originals 303 indicated by the counter 19 does not equal 4d (that is, blank copy sheet sections are required), the copier feeds all of the page -1- copies through to the collator 2 without copying them. It is then necessary to take the copies and place them into the supply bin 6 or 7 in a forward position (copy sheet 301 is fed before sheet 302). If the count m in the counter 19 equals $4d+2$, further copying may proceed. If not, then if the count m equals $4d+3$, copying may proceed as long as m is equal to or less than 5. Otherwise it is necessary to either feed all of the page -3- copies through to the collator 2, without copying, and restack the copies, as previously described, or cause the automatic document feed 3 to feed the next original through to the output area 16 without making a copy. In the latter case, the counter 19 is decremented.

While the invention has been particularly shown and described with reference to preferred embodiments thereof, it will be understood by those skilled in the art that various changes in form and details may be made therein without departing from the spirit and scope of the invention.

What is claimed is:

1. In combination, a copier for providing copy sheets carrying images of indicia from a plurality of original documents, including:

an input stack comprising a plurality of original documents carrying indicia to be copied;

a reproduction position capable of holding one original document at a time;

an automatic document feed for automatically feeding successive ones of the original documents from the input stack to the reproduction position;

an imaging surface, capable of receiving at an image area an image of the indicia on the original document at the reproduction position;

optics, intermediate the reproduction position and the imaging surface, for impressing on a plurality of selectable portions of the imaging surface image area the image of the indicia on the original document at the reproduction position;

a source of blank copy sheets;

reproduction means for providing, at an output, copy sheets carrying reduced images of the indicia on original documents;

first controls, operable to cause the document feed to alternately feed odd-numbered and even-numbered original documents from the input stack to the reproduction position;

second controls, operable to cause the optics to select one portion of the imaging surface image area for odd-numbered original documents and another portion for even-numbered original documents; and third controls, operable to cause the reproduction means to provide, at the reproduction means output, copy sheets, each carrying a reduced image of the indicia from two original documents.

2. The combination of claim 1, further including:

fourth controls, operable to generate a signal which results in the transfer, from the reproduction means output to the source, of copy sheets rotated 180°; and fifth controls, operable to cause the document feed to feed even-numbered original documents from the input stack to the reproduction position in one direction, and odd-numbered original documents rotated 180°.

3. Apparatus for placing images of a number of original indicia on documents on a lesser number of copies, comprising:

a document station for receiving one original at a time;

copying means operable to reproduce, on either one of two positions on each copy, from images provided thereto, indicia on a plurality of originals successively presented to the document station;

supply means, operable to supply originals, one at a time, to the document station;

optical means, associated with the copying means, operable to provide to the copying means, at a selected one of the two positions, a reduced image of the indicia on one original at the document station; and copy manipulation means, for re-presenting to the copying means, copies previously imaged at one position, so that a reduced image of the indicia on another original at the document station is reproduced thereon at another position.

4. Reproduction apparatus for copying graphic marks, on a first number of sides of original documents, as smaller graphic marks on a second number of sides of copy sheets, the first number being greater than the second number, including:

imaging means, operable to optically translate images of graphic marks from entire original document sides to smaller graphic marks on selectable portions of copy sheet sides;

input means, connected to the imaging means, operable to present to the imaging means, one original document side at a time;

supply means, connected to the imaging means, operable to store copy sheets and present to the imaging means one copy sheet side at a time; and control means, connected to the imaging, input and supply means, operable to cause pluralities of original document sides, presented to the imaging means by the input means one side at a time, to be copied on different portions of individual copy sheet sides presented to the imaging means.

5. The apparatus of claim 4, wherein there are additionally provided means, connected to the control means, for indicating that copy sheets presented to the imaging means should be transferred to the supply means and wherein the control means thereupon causes a plurality of original document sides to be copied on one or more copy sheet sides.

6. The apparatus of claim 5, wherein marks from a plurality of successive original document sides, presented to the imaging means by the input means, are copied as reduced-size marks on both sides of each copy sheet.

7. The apparatus of claim 5, wherein marks from each of two successive original document sides of the same original document are copied as adjacent and substantially half-sized marks on the same side of successive copy sheets.

8. The apparatus of claim 5, wherein marks from one side only of each successive original document are copies as reduced-size marks on portions of both sides of copy sheets.

9. The apparatus of claim 5, wherein marks from one side only of each two successive original documents are copied as smaller marks on adjacent portions of one side only of one copy sheet.

10. An improved copier for permitting each copy sheet to carry images of indicia from a plurality of original documents, including:

a plurality of original documents, carrying indicia to be copied, stacked in any desired orientation;

a reproduction position capable of receiving one original document at a time;

an automatic document feed for automatically feeding successive ones of the original documents to the reproduction position;

an examiner for optically examining one original document at the reproduction position at a time and providing an image of the examined document, which image is smaller in area than the examined document;

a surface, associated with the examiner, for receiving the image at either one of two adjacent positions;

reproduction means, associated with the surface, for providing, at an output, copy sheets carrying reduced images of the indicia on the original documents;

first controls, operable to cause the document feed to feed original documents from the input stack to the reproduction position;

second controls, operable to position the image at a selected one of the positions on the surface; and third controls, operable to cause the reproduction means to provide at the reproduction means output copy sheets each carrying reduced images, derived from a plurality of original document sheets.

11. The improved copier of claim 10, wherein there are additionally provided:

fourth controls, operable to generate a signal which results in the recycling of copy sheets through the reproduction means output to the reproduction position.

12. An electrophotographic copier for providing copy sheets carrying images of graphical indicia appearing on a plurality of original document sheets, including:

a plurality of original document sheets, each carrying indicia to be copied, forming an input stack;

a document glass capable of holding one original document sheet at a time;

an automatic document feed for automatically feeding successive ones of the original document sheets from the input stack to the document glass;

a photoconductive surface, capable of receiving at an image area an image of the indicia carried by the single original document sheet on the document glass, the image area being at least as large as a full-size image of the indicia carried on the original document sheet;

optical elements, intermediate the document glass and the photoconductive surface, for impressing on a plurality of selectable portions of the image area a reduced-size image of the indicia on the original document sheet on the document glass;

a bin holding blank copy sheets;

an output receptacle;

reproduction processing means, connected to the photoconductive surface and optical elements, for providing to the output receptacle copy sheets carrying reduced-size images of the indicia on original document sheets;

first controls, connected to the optical elements, automatic document feed and reproduction processing means, operable to cause the document feed to alternately feed odd-numbered and even-numbered original document sheets from the input stack to the document glass;

second controls, connected to the optical elements, automatic document feed and reproduction processing means, operable to cause the optical elements to select one portion of the photoconductive surface image area for odd-numbered original document sheets and another portion for even-numbered original document sheets; and third controls, connected to the optical elements, automatic document feed and reproduction processing means, operable to cause the reproduction processing means to provide, to the receptacle, copy sheets, each carrying a reduced image of the indicia from two original document sheets.

13. The combination of claim 12, further including:

fourth controls, connected to the optical elements, automatic document feed and reproduction processing means, operable to generate a signal which results in the transfer, from the output receptacle to the copy sheet bin, of imaged copy sheets; and fifth controls, connected to the optical elements, automatic document feed and reproduction processing means, operable to cause the document feed to feed even-numbered original document sheets from the input stack to the document glass.

14. Electrophotographic reproduction apparatus for copying graphic marks, including:

a set of original documents, the set having a first number of sides carrying graphic marks;

a set of copy sheets, the set having a second number of sides, the first number being greater than the second number, for receiving graphic marks copied from, and smaller than, the graphic marks on the original documents;

imaging means, operable to optically translate images of substantially all the graphic marks on each original document side to smaller graphic marks on substantially half of each copy sheet side;

input means, connected to the imaging means, operable to present to the imaging means one original document side at a time;

supply means, connected to the imaging means, operable to store copy sheets and present to the imaging means one copy sheet side at a time;

control means, connected to the imaging, input and supply means, operable to cause pluralities of original document sides, presented to the imaging means by the input means one side at a time, to be copied on selected halves of individual copy sheet sides presented to the imaging means; and additional means, connected to the control means, for indicating when copy sheets presented to the imaging means are to be returned to the supply means, thus causing a plurality of original document sides to be copied on one or more copy sheet sides.

15. An improved electrophotographic copier for producing copies of original documents on sheets, each copy sheet carrying images of indicia from a plurality of original documents, including:

a plurality of original documents, carrying indicia to be copied, stacked in any desired orientation;

a reproduction position capable of holding, in a stationary position, one original document at a time;

an automatic document feed for automatically feeding successive ones of the original documents to the reproduction position;

a scanner for optically scanning an original document reproduction position and providing an image of the scanned document thereat, which image is smaller in area than the scanned document;

a moving photoelectric surface, associated with the scanner, for receiving the image at either one of two adjacent positions determined by the scanner;

a source of blank copy sheets;

reproduction means, associated with the photoelectric surface, for placing copying sheets into contact with the moving photoelectric surface and for providing, at an output, copy sheets carrying reduced images of the indicia on original documents;

first controls, operable to cause the document feed to feed original documents in specified orientations from the input stack to the reproduction position; second controls, operable to cause the scanner to position the image at a selected one of a first and second position on the photoconductor;

third controls, operable to cause the reproduction means to provide at the reproduction means output copy sheets each carrying reduced images, derived from a plurality of original document sheets; and fourth controls, operable to generate a signal which results in the transfer of copy sheets from the reproduction means output to the source.

16. A method for providing copy sheets carrying images of the indicia from a plurality of original documents, including the steps of:

feeding successive original documents from an input stack to a reproduction position;

receiving at an image area an image of the indicia on the original document at the reproduction position;

impressing on a plurality of selectable portions of the imaging surface image area the image of the indicia on the original document at the reproduction position;

alternately feeding odd-numbered and even-numbered original documents from the input stack to the reproduction position;

selecting one portion of the imaging surface image area for odd-numbered original documents and another portion for even-numbered original documents; and providing copy sheets, each carrying, on a side, a reduced image of the indicia from two original documents.

17. A method for permitting each copy sheet to carry images of indicia from a plurality of original documents, including:

automatically feeding successive ones of the original documents to a reproduction position;

optically scanning the reproduction position and providing an image of the scanned document thereat, which image is smaller in area than the scanned document;

receiving the image at either one of two adjacent positions on a surface determined by the scanner;

providing, at an output, copy sheets carrying reduced images of the indicia on original documents;

feeding original documents in specified orientations from the input stack to the reproduction position;

positioning the image at a selected one of the positions on the surface; and providing at the output copy sheets each carrying reduced images derived from a plurality of original document sheets.

* * * * *